United States Patent [19]

Tokuno et al.

[11] Patent Number: 4,508,279

[45] Date of Patent: Apr. 2, 1985

[54] SURFACE WINDER

[75] Inventors: Masateru Tokuno, Nishinomiya; Tetsuya Sawata, Nishigyou, both of Japan

[73] Assignee: Rengo Co., Ltd., Osaka, Japan

[21] Appl. No.: 469,276

[22] Filed: Feb. 24, 1983

[30] Foreign Application Priority Data

Feb. 24, 1982 [JP] Japan ..... 57-29600

[51] Int. Cl.[3] ..... B65H 19/20; B65H 17/08

[52] U.S. Cl. ..... 242/56 R; 242/66

[58] Field of Search ..... 242/56 R, 56 A, 66, 242/67.1 R; 226/95

[56] References Cited

U.S. PATENT DOCUMENTS

| | | | |
|---|---|---|---|
| 817,026 | 4/1906 | White | 242/66 |
| 2,449,234 | 9/1948 | Knoble | 242/56 R |
| 3,482,796 | 12/1969 | Mainstone | 242/56 R |
| 3,498,557 | 3/1970 | Ball | 242/66 |
| 3,515,183 | 6/1970 | Voss | 242/66 |
| 3,844,189 | 10/1974 | Jardine | 242/56 A |
| 3,869,095 | 3/1975 | Diltz | 242/66 X |
| 3,918,654 | 11/1975 | Okubo et al. | 242/56 R |
| 4,110,027 | 8/1978 | Sato et al. | 226/95 X |

FOREIGN PATENT DOCUMENTS

| | | | |
|---|---|---|---|
| 815313 | 7/1949 | Fed. Rep. of Germany | 242/66 |

*Primary Examiner*—John M. Jillions
*Assistant Examiner*—Lloyd D. Doigan
*Attorney, Agent, or Firm*—Harding, Earley, Follmer & Frailey

[57] ABSTRACT

A surface winder for a web of sheet material which performs transfer of winding operation from a winding device to another winding device without stopping of the operation or slowing down of the speed of operation. The surface winder comprises plural winding devices, web guide means, a cutting device, web feeding means and means for forming an adhesive layer on the surface of a web. The web guide means are capable of delivering a leading end portion of the web at the winding devices, and the feeding means are capable of feeding the web to the guide means by way of the cutting device.

9 Claims, 9 Drawing Figures

SURFACE WINDER

This present invention relates to a surface winder for producing wound rolls of a web of sheet material.

A so-called surface winder is an apparatus suitable for producing large-sized wound rolls of a web, wherein a winding core is mounted on a pair of drums and rotated by the rotation of the drums, and a fed web is gradually wound up over the winding core up to a large-sized wound roll. Conventionally, however, the surface winder has a defect in that it is difficult for the winder to produce wound rolls continuously without stopping the winding operation or slowing down the speed of the operation.

An object of the present invention is to provide a surface winder capable of producing continuously wound rolls at high speed without stopping the winding operation or slowing down the speed of operation.

Other objects of the invention will be apparent hereinafter.

In accordance with the object, the principle of the present invention is a surface winder comprising plural winding devices each having a pair of supporters for rotatably supporting a winding core, a rider roll for making contact with and pressing a wound roll of a web which has been wound over the winding core, and a pair of drums for mounting and rotating the wound roll, one of said drums being capable of attracting the web to its circumferential surface, web guide means for leading the web to said winding devices, a cutting device disposed upstream of said guide means to sever the web, feeding means for delivering the web after it is severed to said guide means by way of said cutting device, and means for forming an adhesive layer on the surface of a leading end portion of the web which is formed when the web has been severed by said cutting device.

The invention will be described further by way of example with reference to the accompanying drawings in which.

Figure 1:
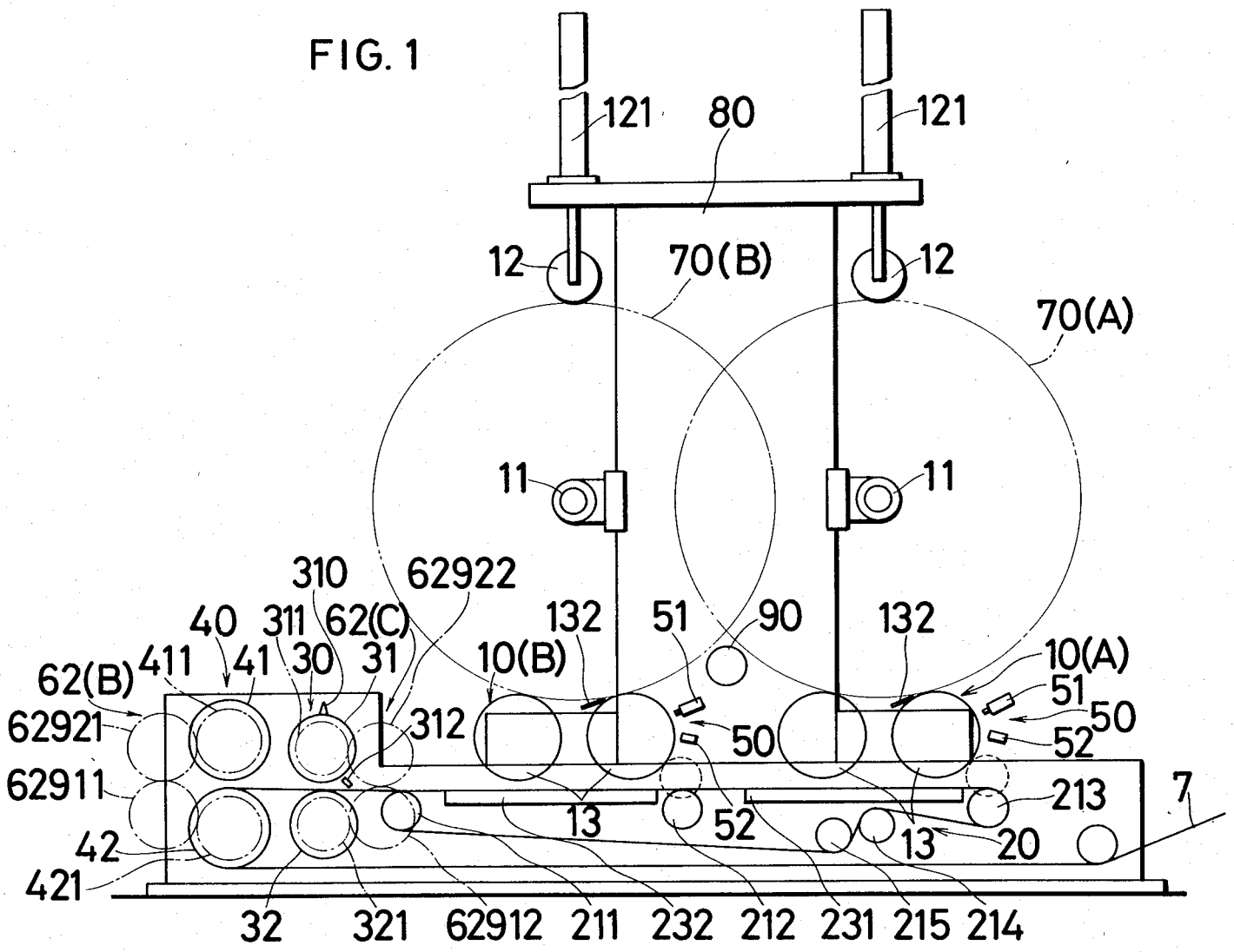
FIG. 1 is a generally diagrammatic side view of one embodiment of a surface winder of the invention.
Figure 2:
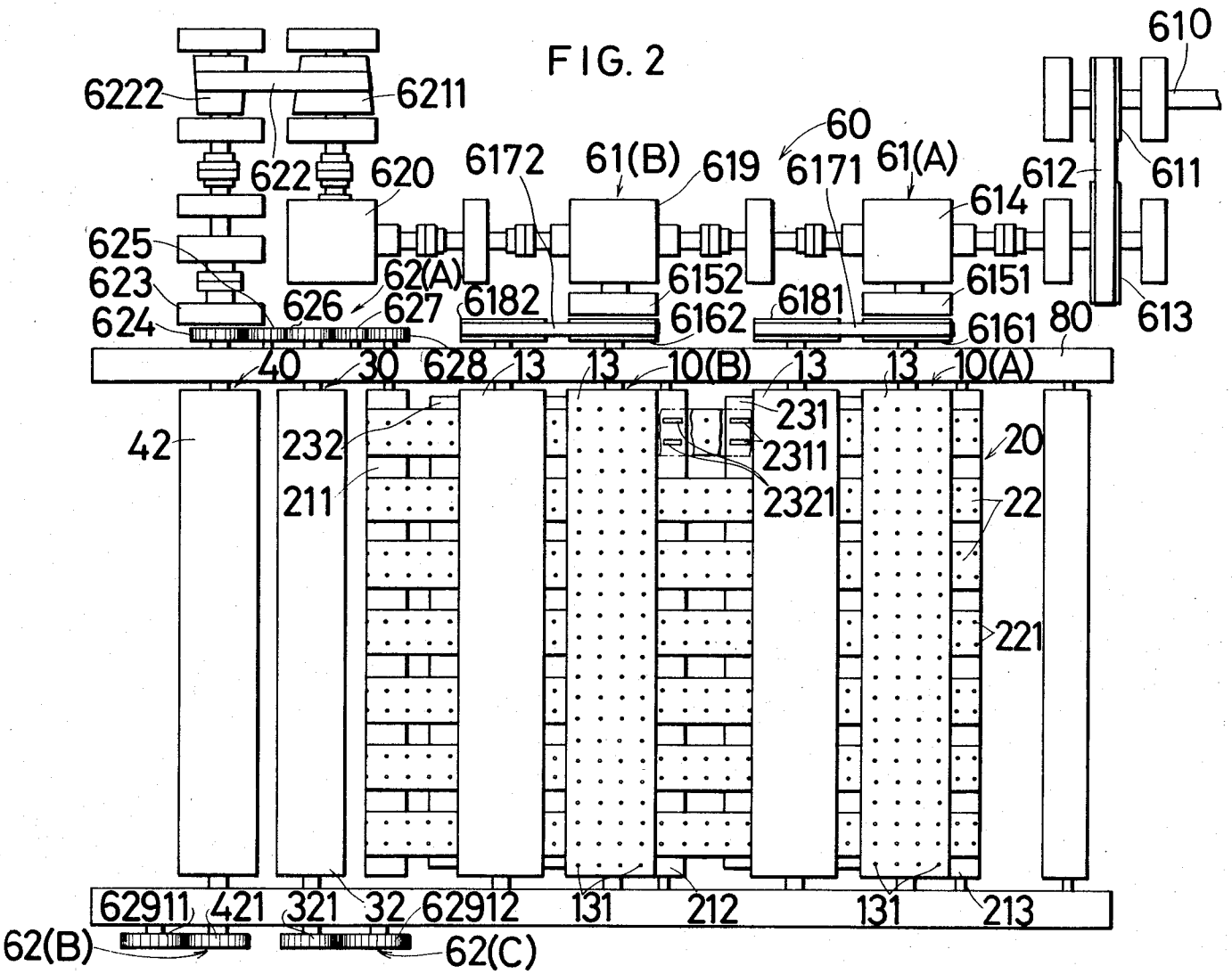
FIG. 2 is a fragmentary view in plan showing principal parts of the embodiment shown in FIG. 1.

Referring to FIGS. 1 and 2, one embodiment of a surface winder of the invention comprises two winding devices 10(A) and 10(B), web guide means 20, a web cutting device 30, intermittent web feeding means 40, means 50 for forming an adhesive layer and a drive means 60.

Each of the winding devices 10 is provided with a pair of spaced supporters 11 for a winding core, a rider roll 12 and a pair of rotatable drums 13. The supporters 11 are of well-known construction and rotatably support a winding core (not shown) made of paper for example. The supporters 11 are capable of ascending along the front and rear edges of a frame 80 as the outer diameter of a wound roll 70 of a web of sheet material 7 increases. The rider roll 12 is of well-known construction and makes contact with and presses the wound roll 70 by means of an oil-cylinder 121. The rider roll 12 is either free for rotation or driven, and capable of adjusting the pressure in accordance with the diameter of the wound roll 70 so as to uniformize the solidity of the wound roll. In place of or in addition to the oil-cylinder 121, a counterweight may be used. The pair of drums 13 are capable of mounting the wound roll 70 on them and capable of driving the wound roll 70 to rotate it. The circumferential surface of one of the drums 13 is provided with a plurality of apertures 131 capable of attracting by suction a portion of the web 7 delivered onto that surface. In addition, if necessary, a scraper 132 capable of coming into contact with the circumferential surface of the apertured drum 13 may be provided for stripping off the portion of the web attracted to its surface. The pair of the drums 13 are rotated in the same direction.

The web guide means 20 comprises guide rollers 211, 212, 213, 214 and 215, plural parallel guide belts 22 each having a plurality of circular sectioned apertures 221 in it, and two suction boxes 231 and 232 each having a plurality of elongated suction apertures 2311 or 2321 in its upper surface. The guide roller 211 is driven for rotation, and the guide rollers 212 and 213 are capable of ascending and descending vertically to permit the guide belts 22 to make contact with or advance to and retract from the apertured drums 13, which are capable of attracting the web 7, of the winding devices 10. The guide rollers 214 or 215 may be raised or lowered, respectively, to adjust the tension of the guide belts 22. The suction boxes 231 and 232 are located just below the upper portion of the guide belts 22 and are capable of attracting a portion of the web by their suction force effected through apertures 221 of the guide belts 22. The suction boxes 231 and 232, however, are not indispensable.

Figure 7:
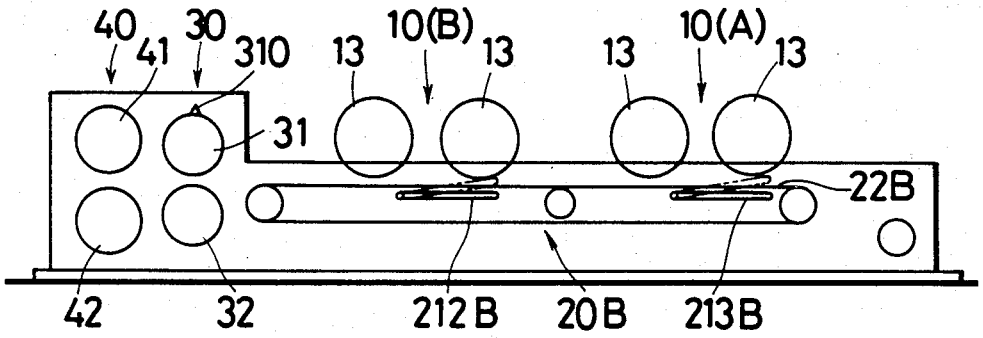
FIGS. 7 and 8 are diagrammatic views of other embodiments of web guide means.
Figure 8:
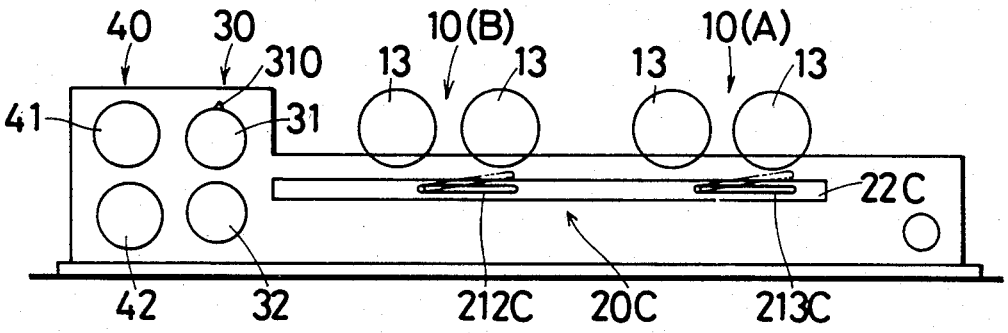

The guide means 20 may be altered to means which guide only portions of the web 7 to the apertured suction drums 13 of the winding devices 10(A) and 10(B). Accordingly, a guide means 20C composed of members such as guide bars 22C as shown in FIG. 8 may be used in place of the guide belts 22. Furthermore, in place of the vertically movable guide rollers 212 and 213, movable bars 212B and 213B as shown in FIG. 7 or movable bars 212C and 213C as shown in FIG. 8 may be used. The movable bars 212B and 213B or the movable bars 212C and 213C extend along the guide belts 22B or guide bars 22C. Each of the movable bars is pivotable about a fulcrum at one of its ends, and the other end ascends and descends so that it may make contact with or approach the apertured drums 13 capable of attracting the web and so that it may retract from the drums 13 and descend below the level of the guide belts 22B or the guide bars 22C.

The cutting device 30 comprises a pair of upper and lower rotatably driven rollers disposed upstream of the guide means 20. The upper roller 31 is composed of a steel roller, for instance, provided with a well-known cutting blade 310, and is capable of ascending and descending so as to approach and retract from the lower roller 32. Furthermore, a detector 312 for detecting the cutting blade 310 of the upper roller 31 is provided opposite to the upper roller 31. The detector 312 is capable of detecting the cutting blade 310 of the upper roller 31 as it is being rotated, for the purpose of generating a signal for lowering the upper roller 31 at the time when it detects the first appearance of the cutting blade 310 after a signal has issued to start to drive the cutting device 30. The detector 312 also is capable of detecting the cutting blade 310 for the purpose of generating a second signal for raising the upper roller 31 at the time when it detects the second appearance of the cutting blade 310. The lower roller 32 has a circumferential surface made of rubber such as polyurethane. A mechanism for raising and lowering the upper roller 31 comprises a pair of rods (not shown) which support both ends of a shaft (not shown) of the upper roller 31 and which are raised and lowered.

Figure 9:
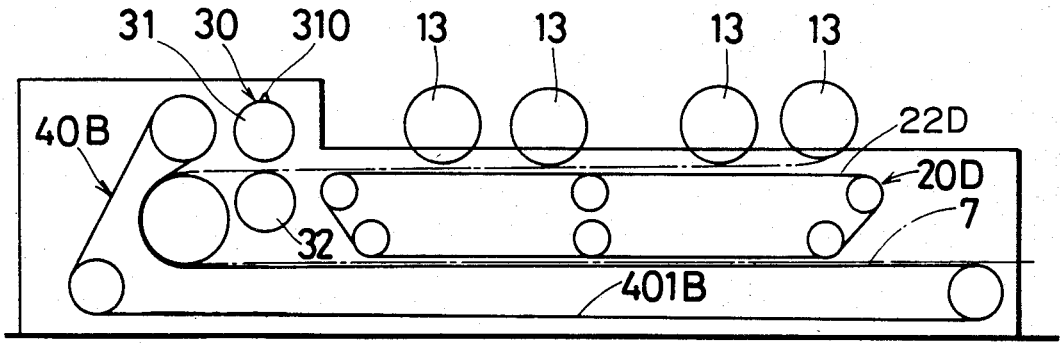
FIG. 9 is a diagrammatic view of another embodiment of the web feeding means.

The feeding means 40 comprise a pair of upper and lower rotatably driven rollers disposed upstream of the cutting device 30. The upper roller 41 is capable of ascending and descending so that it may make contact with the lower roller 42. In this embodiment the upper roller 41 has a peripheral surface made of rubber, while the peripheral surface of the lower roller 42 is made of steel. A mechanism for raising and lowering the upper roller 41 comprises a pair of rods (not shown) which support both ends of a shaft (not shown) of the upper roller 41 and which are raised and lowered. The mechanism, however, is not indispensable. The web feeding means 40 operate intermittently and are provided for delivering the web 7 to the winding devices 10 after the web has been severed by the cutting device 30. However, the web feeding means may be the same as the guide means 20 provided with the suction attracting force as shown in FIGS. 1 and 2 or the same as the web feeding means 40B shown in FIG. 9. The means 40B as shown in FIG. 9 comprise continuously driven endless belts 401B closely confronting web guide means 20D, and are capable of holding the web 7 between the belt 401B and the endless belts 22D of the web guide means 20D. In place of the endless belts 22D, other endless belts (not shown) may be provided closely confronting the endless belts 401B.

Figure 5:
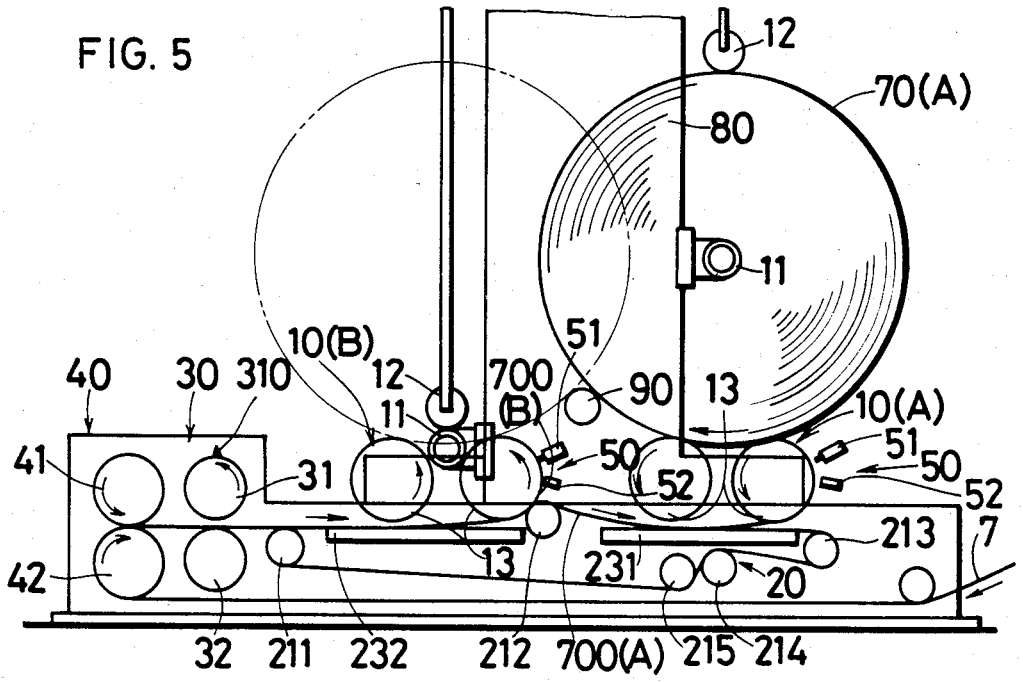

The adhesive applying means 50 for each winding device 10(A), 10(B) is provided for forming an adhesive layer on the leading end portion 700(B) (FIG. 5) of the web 7 which is made when the web 7 has been severed by the cutting device 30. The adhesive layer is formed so as to stick the leading end portion 700(B) onto the winding core (not shown), and the means 50 comprises an adhesive applicator 51 (a hot melt applicator) and a phototube detector 52 disposed adjacent each of the apertured drums 13. As shown in FIG. 5, the applicator 51 is capable of spraying adhesive onto the leading end portion 700(B) of the web 7 for a certain time after receiving a signal from the phototube detector 52. The phototube detector 52 is provided for detecting the end portion 700(B) of the web 7, which has been attracted by suction to the surface of the apertured drum 13, to generate a signal for actuating the applicator 51.

Without the phototube detector, it may be possible to spray adhesive for a certain time when the leading end portion of the web 7 has reached a position located a little ahead of the adhesive applicator 51. The means 50 may be a device wherein the peripheral surface of the upper roller 41 or the lower roller 42 of the feeding means 40 is treated with nonadherent material such as tetrafluoroethylene resin, and a double faced adhesive tape is temporarily put on the surface and transferred to the web 7 which makes contact with the roller, and thus an adherent surface is formed on the web 7.

The drive means 60 of the surface winder of the invention comprises drive means 61(A) and 61(B) for the pairs of drums 13 of the winding devices 10(A) and 10(B), the guide roller 211 of the guide means 20, and drive means 62(A) for the lower roller 42 of the feeding means 40, as shown in FIG. 2, and drive means 62(B) for the upper roller 41 of the feeding means 40 and drive means 62(C) for the upper roller 31 of the cutting device 30 as shown in FIG. 1. The drive means 61(A) comprise pulley 611, belt 612, pulley 613, gear box 614, clutch 6151, pulley 6161, belt 6171 and pulley 6181, and is capable of interruptably transmitting a driving force from a drive shaft 610 to the pair of drums 13 of the winding device 10(A). The drive means 61(B) comprise gear box 619, clutch 6152, pulley 6162, belt 6172 and pulley 6182, and is capable of transmitting interruptably the driving force from the gear box 614 to the pair of drums 13 of the winding device 10(B). The drive means 62(A) comprise gear box 620, conical pulley 6211, belt 622, conical pulley 6222, clutch 623 and gears 624, 625, 626, 627 and 628, and are capable of interruptably transmitting the driving force from the gear box 619 to the lower roller 42 of the feeding means 40, the lower roller 32 of the cutting device 30 and the guide roller 211 of the guide means 20. The drive means 62(B) comprise gears 421, 62911, 62921 and 411, and are capable of transmitting the driving force from the lower roller 42 of the feeding device 40 to the upper roller 41. The drive means 62(C) comprise gears 321, 62912, 62922 and 311, and are capable of transmitting the driving force from the lower roller 32 of the cutting device 30 to the upper roller 31.

All of the drive means are of well-known construction, and accordingly further detailed explanation is omitted. Furthermore, it is a matter of course that the drive means are not limited to those as explained above, and that the clutches 6151, 6152 and 623 are not indispensable.

Next, a transfer of the winding operation of the surface winder of the invention will be explained, as illustrated in FIGS. 3–6.

Figure 3:
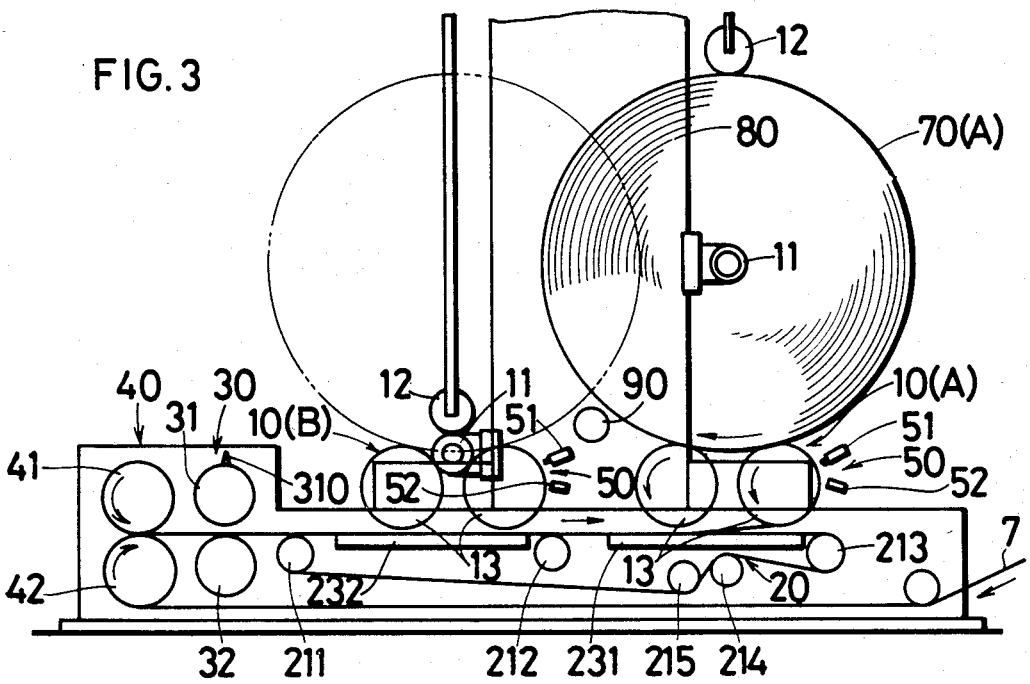
FIGS. 3 through 6 are diagrammatic views of the transfer of the winding operation from one winding device to another.

In this case, the winding device 10(A) is in operation and the winding device 10(B) is out of operation. As shown in FIG. 3, the pair of drums 13 of the winding device 10(A) are driven to rotate counterclockwisely. A wound roll 70(A) of the web is rotated on the pair of drums with a winding core (not shown) as the axis of rotation. The core is supported by a pair of spaced supporters 11 capable of ascending along the frame 80, and a rider roll 12 is in rotation making contact with the wound roll and pressing it. The web 7 passes around the lower roller 42 of the feeding means 40, and over lower roller 32 of the cutting device 30 and over guide means 20, and is delivered by the apertured drum 13 to the wound roll 70(A). Belts 22 of the guide means 20 are out of operation and guide rollers 212 and 213 have been lowered. Suction apertures 2311 and 2321 of suction boxes 231 and 232 are out of operation. Furthermore, the cutting device 30 and the feeding means 40 are out of operation and the upper and lower rollers of both the cutting device and the feeding means have been separated.

When a signal issues to direct preparation for the transfer of operation to the winding device 10(B), a winding core (not shown) supported by supporters 11 is put on the pair of drums 13, and subsequently the rider roll 12 descends and makes contact with the winding core and presses it. The pair of drums 13 are driven rotatably in accordance with actuation of the clutch 6152, and synchronized with the running speed of the web. Also, the apertured drum 13 capable of attracting the web is vacuumized. In accordance with actuation of the clutch 623 of the drive means 62(A), guide belts 22 of the guide means 20 are driven, and the lower roller 32 of the cutting device 30 and the lower roller 42 of the feeding means 40 are rotated. Simultaneously by means of the drive means 62(B) and 62(C), the upper roller 31 of the cutting device 30 and the upper roller 41 of the intermittent feeding means 40 are rotated. Subsequently the upper roller 41 of the feeding means is lowered and the suction box 232 is vacuumized.

Figure 4:
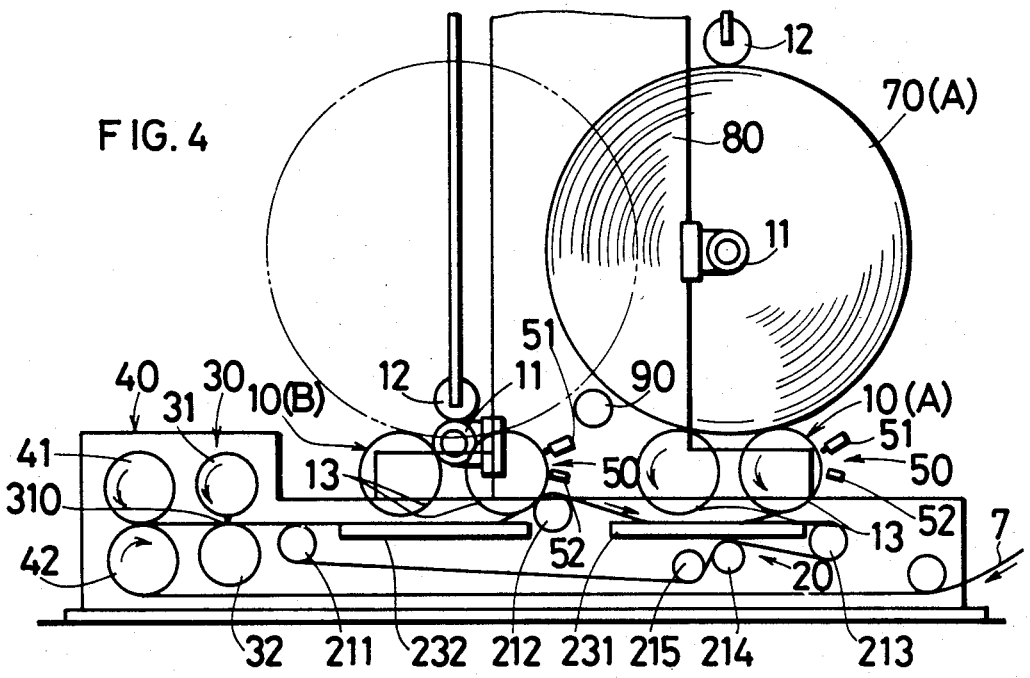
Figure 6:
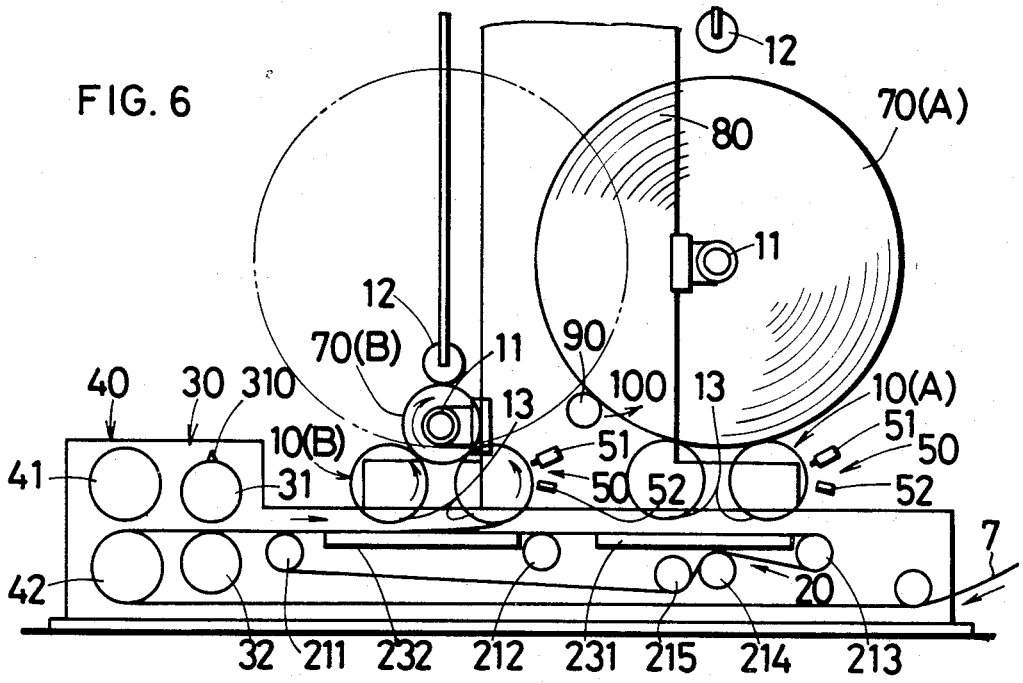

After a signal for directing a transfer of operation issues, the upper roller 31 of the cutting advice 30 is lowered when the blade 310 first passes by the detector 312 (FIG. 1) for detecting the blade, and subsequently the roller 31 is raised when the blade 310 again passes by the detector 312. During this interval of time the web 7 has been cut, and the tailing end portion 700(A) of the web 7 proceeds to be wound over the wound roll 70(A) as shown in FIGS. 4 and 5, while the leading end portion 700(B) of the cut web 7 is attracted to the circumferential surface of the apertured drum 13 of the winding device 10(B), because the guide roller 212 is simultaneously raised with the result that the guide belts 22 make contact with or approach the surface of that drum. The leading end portion 700(B) is detected by the phototube detector 52 adjacent the drum. A signal generated by the phototube detector 52 actuates adhesive applicator 51 a certain time later, and the adhesive applicator 51 is operative to spray adhesive. The leading end portion 700(B) on which adhesive has been applied adheres to the surface of the core and is wound over the core. After the wound roll 70(B) of the web begins to rotate on the pair of drums 13 of the winding device 10(B), the clutch 6151 of the drive means 61(A) and the clutch 623 of the drive means 62(A) are disengaged. Simultaneously, vacuumization of the suction box 232 is stopped, the guide roller 212 is lowered, and the upper roller 41 of the feeding device 40 is raised. Subsequently, as shown in FIG. 6, the rider roll 12 of winding device 10(A) is raised by means of the cylinder 121, a conventional kicker roll 90 is moved in the direction designated by an arrow 100, and the wound roll 70(A) is taken away from the pair of drums 13. Thus the operation of the transfer is over.

The operation to be carried out when a wound roll 70(B) of the web has been completed is the same as the operation explained above, so further explanation is omitted.

As explained above, the surface winder of the present invention performs the transfer of the winding operation from one winding device to another winding device successfully without stopping the operation or reducing the speed of the winding devices, and thus produces continuously large-sized wound rolls of the web at high speed.

We claim:

1. A surface winder having plural winding devices for winding rolls from a web of sheet material, each winding device including a pair of spaced supporters for supporting a winding core rotatably, a rider roll for pressing a wound roll during winding and a pair of rotatable drums for supporting and rotating the wound roll during winding, characterized by (a) one drum of said pair of drums of each winding device being capable of attracting a portion of the web to its circumferential surface by suction, (b) web guide means disposed below the winding devices operative to direct the web selectively to the drums of one or the other of said winding devices, (c) a cutting device disposed upstream of said web guide means to sever the web periodically, thereby producing a cut web having a leading end portion, (d) web feeding means operative to deliver the web, after it has been severed, to said web guide means and (e) adhesive application means disposed adjacent each drum capable of attracting the web by suction, (f) said adhesive application means being operative to form an adhesive layer on the leading end portion of the web when said end portion is on said drum.

2. A surface winder as claimed in claim 1, wherein each drum capable of attracting a portion of the web to its circumferential surface is a suction drum having a plurality of suction apertures formed in its circumferential surface.

3. A surface winder as claimed in claim 2, wherein the web guide means includes (a) a driving guide roller, (b) a plurality of driven guide rollers and (c) plural endless guide belts extending around the driving and driven guide rollers, (d) said driven guide rollers including retractable guide rollers disposed adjacent each suction drum, (e) said retractable rollers being operative to advance the guide belts to and to retract the guide belts from said suction drums.

4. A surface winder as claimed in claim 3, wherein the web guide means further includes at least one suction box located adjacent the guide belts, each suction box being capable of attracting the web onto the guide belts.

5. A surface winder as claimed in claim 3, wherein the web guide means further includes plural pivotal bars located adjacent the guide belts and extending along said belts, said pivotal bars each being fulcrumed at one end whereby their opposite ends are operative to advance the guide belts to the suction drums.

6. The surface winder as claimed in claim 2, wherein the web guide means includes (a) plural web guide bars and (b) plural pivotal bars located adjacent the web guide bars and extending along said bars, (c) said pivotal bars each being fulcrumed at one end whereby their opposite ends are operative to advance the guide belts to the suction drums.

7. A surface winder as claimed in claims 1, 2, 3 or 4 wherein the web feeding means comprises a pair of rotatably driven retractable rollers capable of being rotated in opposite directions to each other, said rollers being retracted from each other when inoperative and being advanced to contact each other when operative to deliver the severed web to the web guide means.

8. A surface winder as claimed in claims 1, 2, 3 or 5 wherein the web feeding means comprises (a) a driving guide roller, (b) a plurality of driven guide rollers, (c) plural endless guide belts extending around the driving and driven guide rollers and (d) a suction box located adjacent the guide belts, said suction box being capable of attracting a portion of the web to the belts.

9. A surface winder as claimed in claims 1, 2, 3 or 5, wherein the web feeding means comprises a pair of endless belts located adjacent each other, said belts having closely confronting portions whereby said belts are capable of holding the web between their confronting portions.

* * * * *